US008087842B2

(12) United States Patent
Bouix et al.

(10) Patent No.: US 8,087,842 B2
(45) Date of Patent: Jan. 3, 2012

(54) MULTI-COMPARTMENT, WIPER-APPLICATOR PACKAGE

(75) Inventors: Herve F. Bouix, New York, NY (US); William R. Bickford, Ronkonkoma, NY (US); Elsa Marie Ovtchinnikoff, Nimes (FR)

(73) Assignee: ELC Management, LLC, New York, NY (US)

( * ) Notice: Subject to any disclaimer, the term of this patent is extended or adjusted under 35 U.S.C. 154(b) by 752 days.

(21) Appl. No.: 12/164,161

(22) Filed: Jun. 30, 2008

(65) Prior Publication Data

US 2009/0320871 A1 Dec. 31, 2009

(51) Int. Cl.
*A46B 17/08* (2006.01)

(52) U.S. Cl. ..... 401/122

(58) Field of Classification Search ..... 401/121, 401/122, 124, 126–129, 132–134
See application file for complete search history.

(56) References Cited

U.S. PATENT DOCUMENTS 3,713,780 A * 1/1973 Shapiro ..... 422/413
7,131,784 B2 * 11/2006 Lee et al. ..... 401/128
7,481,592 B2 * 1/2009 Gueret ..... 401/129
2006/0032512 A1 2/2006 Kress et al.
2007/0286665 A1 12/2007 Bouix et al.

FOREIGN PATENT DOCUMENTS

KR 20040108377 12/2004
KR 1020040108377 12/2004
KR 20070065158 6/2007
KR 1020070065158 6/2007

OTHER PUBLICATIONS

PCT International Search Report; International Application No. PCT/US2009/048546; Completion Date: Jan. 19, 2010; Date of Mailing: Jan. 20, 2010.
PCT Written Opinion of the International Searching Authority, or the Declaration; International Application No. PCT/US2009/048546; Completion Date: Jan. 19, 2010; Mailing Date: Jan. 20, 2010.

* cited by examiner

*Primary Examiner* — Huyen Le
(74) *Attorney, Agent, or Firm* — Ka Wah J. Lee; Peter Giancana

(57) ABSTRACT

A multi-compartment, wiper-applicator package comprising a container holding a first formulation, a wiper, initially sealed at both ends and a barbed tool. Within the sealed wiper is a quantity of secondary ingredients that is to be mixed with the first formulation in the container. The barbed tool is able to pierce the top seal, then dislocate the bottom seal, completely separating the bottom seal from the wiper. Thereafter the barbed tool removes the top seal completely, so that, what remains, is a conventional wiper. The barbed tool can be inserted only to a defined depth in the wiper. This prevents the barbed tool from removing the wiper from the container.

17 Claims, 5 Drawing Sheets

MULTI-COMPARTMENT, WIPER-APPLICATOR PACKAGE

FIELD OF THE INVENTION

The present invention is in the field of cosmetic packaging, in particular, multi-compartment packages that have a wiper.

BACKGROUND OF THE INVENTION

Throughout the specification, we describe mascara formulations packaged in a multi-compartment package according to the present invention. However, the invention is applicable to any product that is suitable for use with a wiper-applicator system.

Containers that have a wiper element are well known in the art. A typical mascara package, for example, comprises a bottle capable of holding a quantity of mascara, a wiper disposed in the neck of the bottle and a closure-applicator that screws onto the neck of the bottle. The typical mascara package has a single compartment and is capable of holding only one formulation at a time. Thus, the preparation that reaches the consumer is the formulation that was filled into the single compartment package, at the filling plant.

In contrast, the present invention is a multi-compartment, wiper-applicator package. Throughout the specification, the phrase "multi-compartment, wiper-applicator package" refers to a package that comprises a container; a wiper that is sealed at both ends and that is disposed in an opening of the container; and a tool for removing the seals from the wiper. Further associated with the "multi-compartment, wiper-applicator package" is an applicator that accesses the interior of the container by passing through the wiper after the seals have been removed.

One of the advantages of the present invention, is the increased formulation flexibility provided by the multi-compartment design of the package. This increased formulation flexibility has advantages for the formulator, the manufacturer and the consumer.

Conventional mascara formulations include oil-in-water emulsion mascaras which may typically have an oil phase to water ratio of 1:7 to 1:3. Oil-in-water mascaras are typically comprised of emulsifiers, polymers, waxes, fillers, pigments and preservatives. These mascaras offer the benefits of good stability, wet application and easy removal with water, they are relatively inexpensive to make, a wide array of polymers may be used in them and they are compatible with most plastic packaging. There are also water-in-oil mascaras whose principle benefit is water resistance and long wearability. These mascaras may typically have an oil phase to water ratio of 1:2 to 9:1. Water-in-oil mascaras are typically comprised of emulsifiers, solvents, polymers and pigments.

In general, however, mascara compositions may also include ingredients whose efficacy or potency decreases with time. Thus, the time from filling the mascara container until the first use by the consumer, represents a loss of efficacy or potency. To compensate for this, a formulator may include more of the ingredient than is really needed by the consumer. For example, a lash curling enzyme may slowly breakdown in the mascara composition. To ensure that there is an efficacious amount of the enzyme by the time the consumer uses the product, extra enzyme may be put into the composition. This is an obvious disadvantage, as the enzyme may be expensive or the degraded enzyme may further disturb the chemical composition. Thus, it would be advantageous if the enzyme could be protected from degradation until the time of first use by the consumer.

Furthermore, a formulator may wish to include in the mascara composition, an ingredient that is reactive with the composition for some beneficial purpose. However, in some situations, it may be advantageous to delay that reaction until the time of first use by a consumer. That is not possible with a conventional, single compartment mascara container, but it is possible with the "multi-compartment, wiper-applicator package" of the present invention. Also, there may be other reasons for wanting to maintain one or more ingredients separate from the main mascara composition until the time of first use. Regardless of the reasons, such is not possible with a conventional, single compartment mascara container, but it is possible with a "multi-compartment, wiper-applicator package" according to the present invention.

There is an established vocabulary for discussing the performance characteristics of mascara compositions. Each of these characteristics can be evaluated and assigned a number on a random scale, from 0 to 10, say, for purposes of comparison during formulation. "Clumping", as a result of mascara application, is the aggregation of several lashes into a thick, rough-edged shaft. Clumping reduces individual lash definition and is generally not desirable. "Curl" is the degree to which a mascara causes upward arching of the lashes relative to the untreated lashes. Curl is often desirable. "Flaking" refers to pieces of mascara coming off the lashes after defined hours of wear. The better quality mascaras do not flake. "Fullness" depends on the volume of the lashes and the space the between them, where "sparse" (or less full) means there are relatively fewer lashes and relatively larger separation between the lashes and "dense" (or more full) means the lashes are tightly packed with little measurable space between adjacent lashes. "Length" is the dimension of the lash from the free tip to its point of insertion in the skin. Increasing length is frequently a goal of mascara application. "Separation" is the non-aggregation of lashes so that each individual lash is well defined. Good separation is one of the desired effects of mascara application. "Smudging" is the propensity for mascara to smear after defined hours of wear, when contacting the skin or other surface. Smearing is facilitated by the mascara mixing with moisture and/or oil from the skin or environment. "Spiking" is the tendency for the tips of individual lashes to fuse, creating a triangular shaped cluster, usually undesirable. "Thickness" is the diameter of an individual lash, which may be altered in appearance by the application of mascara. Increasing thickness is usually a goal of mascara application. "Wear" is the visual impact of a mascara on the lashes after defined hours as compared to immediately after application. "Overall look" is one overall score that factors in all the above definitions. It is a subjective judgment comparing treated and untreated lashes or comparing the aesthetic appeal of one mascara to another. The ideal mascara will possess all of the desirable properties while avoiding the undesirable. Unlike a typical mascara package, the "multi-compartment, wiper-applicator package" of the present invention makes it easier to achieve the ideal mascara.

Wipers are well known in the art and are especially encountered in products where an applicator is immersed in a flowable preparation, like a lotion, or immersed in a pasty preparation, like mascara. A typical prior art wiper is shown in FIGS. 1 and 2. Broadly defined, the wiper (100) is a hollow cylinder. The typical wiper has one retention bead (101). When the wiper is fully seated on a mascara container, the bead fits into a complimentary retention groove located on the inner wall of the container neck. The bead and neck groove stabilize the wiper in the container neck by opposing any movement of the wiper, as for example, when a brush passes through the wiper. A lower section (102) of the wiper is tapered such that it has a smaller diameter than that of the upper section (103) of the wiper. The upper section terminates in an upper orifice (104) and the lower section terminates in a lower orifice (105). As commonly practiced, the lower orifice diameter is typically between 0.139 and 0.163 inches, although other sizes may be in use and the present invention is not limited by the size of the lower orifice. This range of orifice diameters accommodates most of the brush-rod applicator assemblies currently in use. The well known wiper as just described, is incapable of transforming a single compartment package into a dual or multi-compartment package.

OBJECTIVES

A main object of the present invention is to provide a "multi-compartment, wiper-applicator package".

Another object of the present invention is to provide a wiper that transforms a single compartment package into a multi-compartment package.

Another object of the present invention is to provide a mascara package that gives to the user an ability to alter the performance properties of the mascara at the time of first use.

Another object of the present invention is to provide a mascara package that gives to the user an ability to complete the mascara formulation at the time of first use.

Another objective of the present invention is to improve mascara performance by providing mascara compositions that are completed at the time of first use.

The foregoing objectives and other benefits may be realized in a "multi-compartment, wiper-applicator package", as described herein. Other objects of the invention and the advantages of it will be clear from reading the description to follow.

SUMMARY

A "multi-compartment, wiper-applicator package" according to the present invention comprises a container that is capable of holding a first formulation. The container has an opening that provides access to the first formulation. The opening is capable of receiving a wiper, in a manner well known in the art. For example, the wiper is friction fit into the neck of the container. The opening may typically take the form of a bottle neck, and the neck may have a neck finish of the container that is capable of receiving a closure. A wiper according to the present invention is, initially, sealed at both ends. Within the sealed wiper is a quantity of secondary ingredients that is to be mixed with the first formulation in the container. A "multi-compartment, wiper-applicator package" according to the present invention includes a barbed tool. At the time of first use, the barbed tool is able to pierce the top seal, then dislocate the bottom seal, completely separating the bottom seal from the wiper. Thereafter the barbed tool removes the top seal completely, so that, what remains, is a conventional wiper. The barbed tool can be inserted only to a defined depth in the wiper. This prevents the barbed tool from removing the wiper from the container.

DETAILED DESCRIPTION OF THE INVENTION

Figure 1:
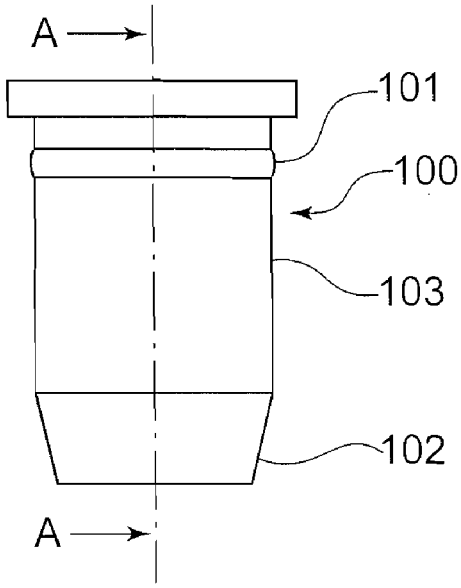
FIG. 1 (Prior Art)
FIG. 1 is a typical prior art wiper.
Figure 2:
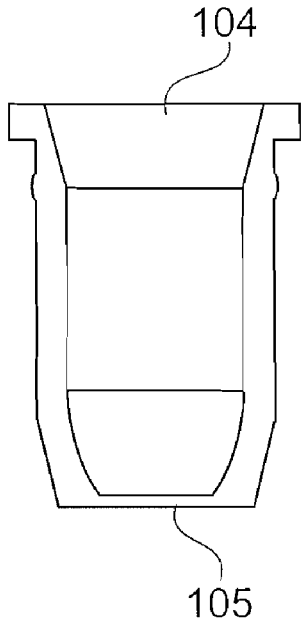
FIG. 2 (Prior Art)
FIG. 2 is a cross section through line A-A of FIG. 1.
Figure 3:
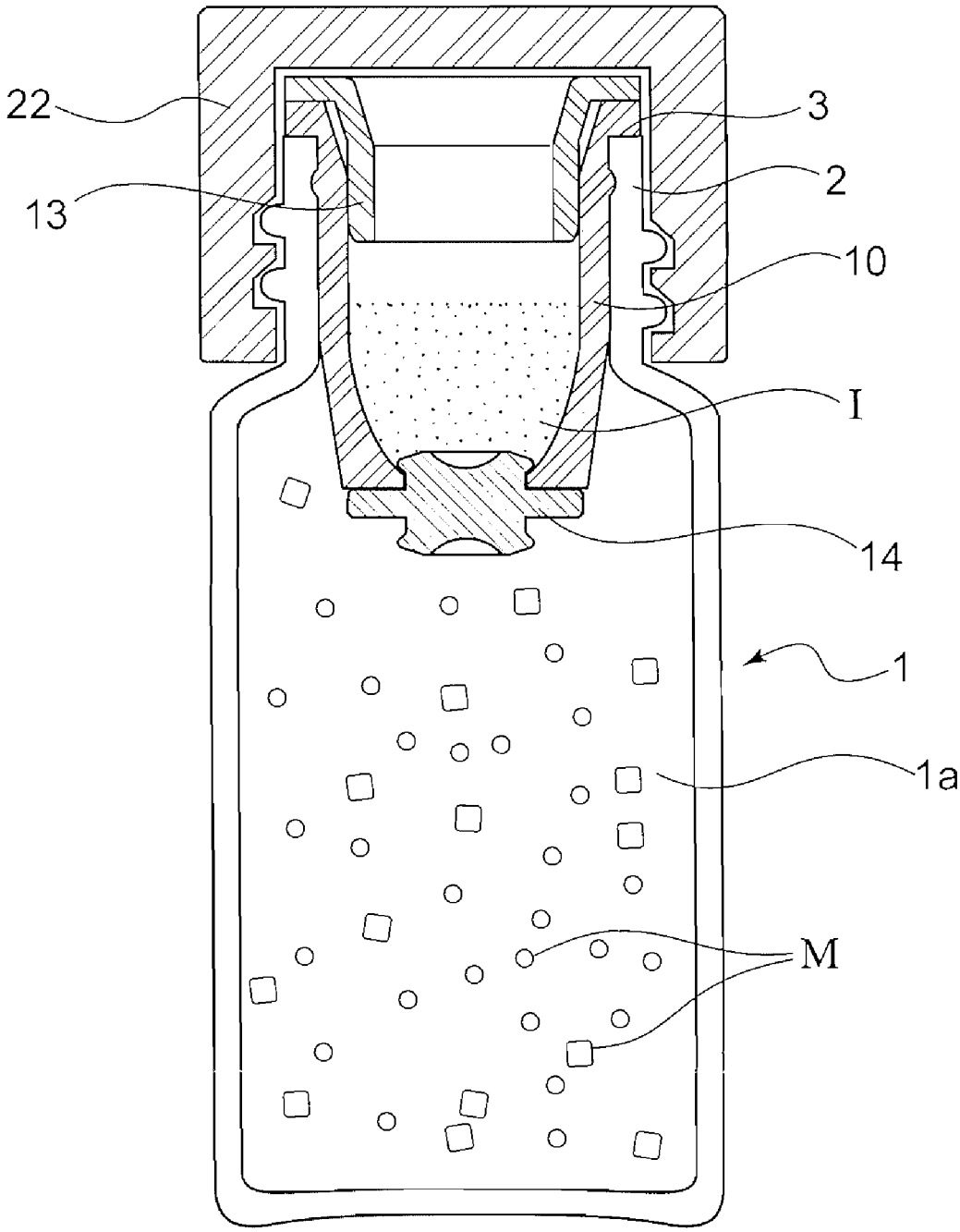
FIG. 3 is a cross section of a "multi-compartment, wiper-applicator package".

A "multi-compartment, wiper-applicator package" according to the present invention (FIG. 3) comprises a container (1) that is capable of holding a first formulation (M). In the case of mascara, the container is generally a cylindrical vial having a neck (2) with a screw threaded finish. The top (3) of the neck has an orifice that allows access to the interior of the container.

Figure 4A:
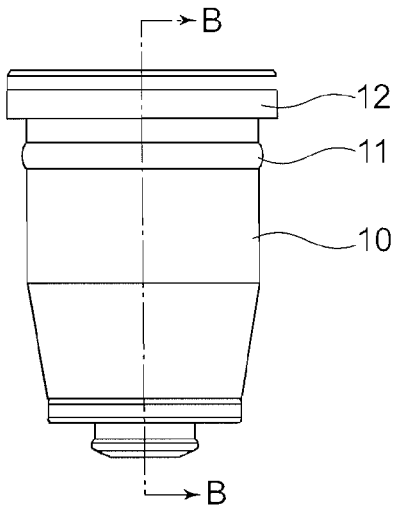
FIG. 4*a* is an elevation view of one non-limiting embodiment of a wiper according to the present invention.
Figure 4B:
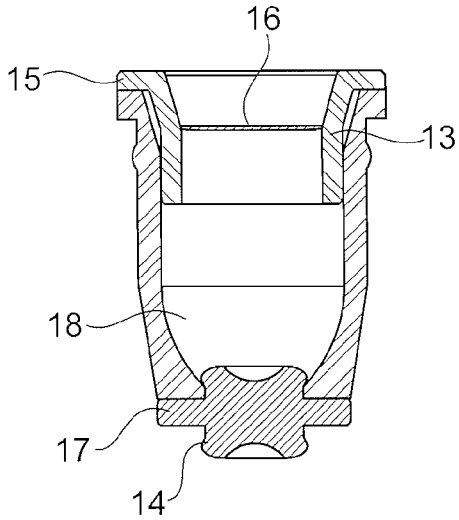
FIG. 4*b* is a cross section through line B-B of FIG. 3.
Figure 5A:
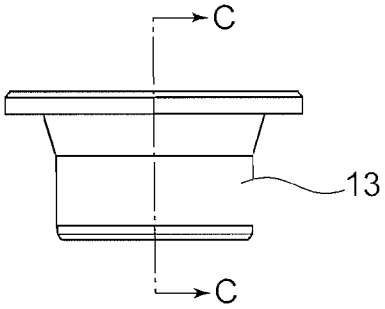
FIG. 5*a* is an elevation view of one non-limiting embodiment of the upper seal of a wiper according to the present invention.
Figure 5B:
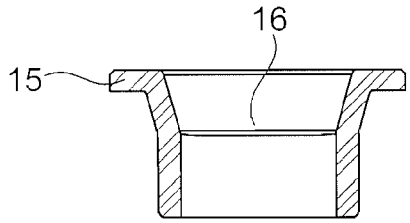
FIG. 5*b* is a cross section through line C-C of FIG. 5.
Figure 6A:
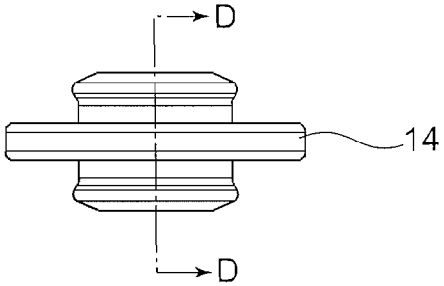
FIG. 6*a* is an elevation view of one non-limiting embodiment of the lower seal of a wiper according to the present invention.
Figure 6B:
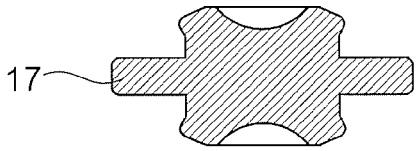
FIG. 6*b* is a cross section through line D-D of FIG. 7.

A novel wiper (10) is disposed in the neck (2) of the container (1). The wiper is secured in the neck of the container such that it cannot easily or accidentally be removed during normal use. Generally, a tight friction fit between the wiper and container neck is sufficient to ensure this. Referring to FIGS. 4*a* and 4*b*, a wiper may have one or more raised beads (11) that ensure sufficient retention of the wiper in the container neck. The friction fit between the wiper and container neck is as air tight as that term is generally understood in the art. A typical wiper may have a flange (12) that rests on the top (3) of the container neck, when the wiper is fully seated in the container. The wiper has an upper orifice and a lower orifice, similar to a conventional wiper. Prior to first use, as shown in FIGS. 4 and 4*b*, the upper and lower orifices are sealed by an upper seal (13) and a lower seal (14), respectively.

The upper seal (13) closes off the upper orifice of the wiper (10) and forms an air tight and/or fluid tight seal with the wiper. Preferably, the upper seal is friction fit to the wiper to achieve the air tight seal. For example, the upper seal could surround the wiper flange (12) such that the air tight connection is achieved against the exterior of the wiper. Preferably, however (and as shown in FIG. 4*b*), the upper seal is inserted into the upper orifice of the wiper and a friction fit is achieved between the exterior of the upper seal and the interior of the wiper. This arrangement may create a more sleek, less bulky appearance.

The upper seal (13) may be provided with a flange (15) that rests against the flange of the wiper (10) when the upper seal is fully seated on the wiper. However, the contact between the upper seal flange and the wiper flange is not the primary seal. The upper seal flange merely limits the depth to which the upper seal can be inserted into the wiper. The primary air tight seal occurs inside the wiper, down a distance.

The upper seal also has a weakened portion (16) that can be pierced or punctured relatively easily with a sharp object. In FIG. 4*b*, the weakened portion is located a distance down, into the upper seal. The weakened portion is relative to the rest of the upper seal, which cannot be pierced or punctured as easily as the weakened portion.

While an air tight friction fit exists between the upper seal (13) and the wiper (10), this fit should not be so tight that pulling the upper seal would dislodge the wiper from the container (1). Simultaneously, this fit should not be so tight that it is unduly difficult for a consumer to remove the upper seal from the wiper. A person of skill in the art may, by routine experimentation, arrive at the correct air tight fit. After the upper seal is removed, it is imperative that an airtight seal be possible between the flange (12) of the wiper and the container closure.

The lower seal (14) closes off the lower orifice of the wiper (10) and forms an air tight and/or fluid tight seal with the wiper. Preferably, the lower seal is friction fit to the wiper to achieve the seal. For example, the lower seal could surround a lower portion of the wiper such that the air tight connection is achieved against the exterior of the wiper. Preferably, however (and as shown in FIG. 4*b*), the lower seal is inserted into the lower orifice of the wiper and a friction fit is achieved between the exterior of the upper seal and the interior of the wiper. This arrangement may create a slimmer wiper profile, that can fit into standard container openings.

The lower seal (14) may be provided with a flange (17) that rests against the base of the wiper (10) when the lower seal is fully seated on the wiper. The lower seal flange will limit the depth to which the lower seal can be inserted into the wiper. Unlike the upper seal, the lower seal does not have a weakened portion that can be pierced or punctured relatively easily with a sharp object. A weakened portion in the lower seal might defeat the operation of the invention.

While an air tight friction fit exists between the lower seal (14) and the wiper (10), this fit should not be so tight that it is unduly difficult for a consumer to dislodge the lower seal from the wiper. A person of skill in the art may, by routine experimentation, arrive at the correct fit.

The container (1) defines a primary compartment (1*a*). The sealed wiper (10) creates a secondary compartment (18) which can hold a quantity of secondary ingredients (I). There are a number of options for assembling and filling the components.

For example, the container (1) can be filled in a usual manner with a first formulation (M). The lower seal (14) can be affixed to the wiper (10). The wiper can be filled with a quantity of secondary ingredients (I). The upper seal (13) can be affixed to the wiper. Then, the sealed wiper can be affixed into the container orifice.

Alternatively, the container (1) can be filled in a usual manner with a first formulation (M). The lower seal (14) can be affixed to the wiper (10). Then, the partly sealed wiper can be affixed into the container orifice. Then the wiper can be filled with a quantity of secondary ingredients (I) and the upper seal can be affixed to the wiper.

Once the package is filled and assembled, a closure (22) for the container is optional. The closure would screw onto the container in the usual manner, except that when fully seated, the closure would bear down directly on the upper seal flange (15), rather than on the wiper flange (12). Of course, this closure does not have an applicator depending from it, as is commonly done in the art. Thus, the applicator must be separately supplied, to be used after the upper (13) and lower (14) seals have been dislodged.

Figures 7A, 7B, 7C, 7D:
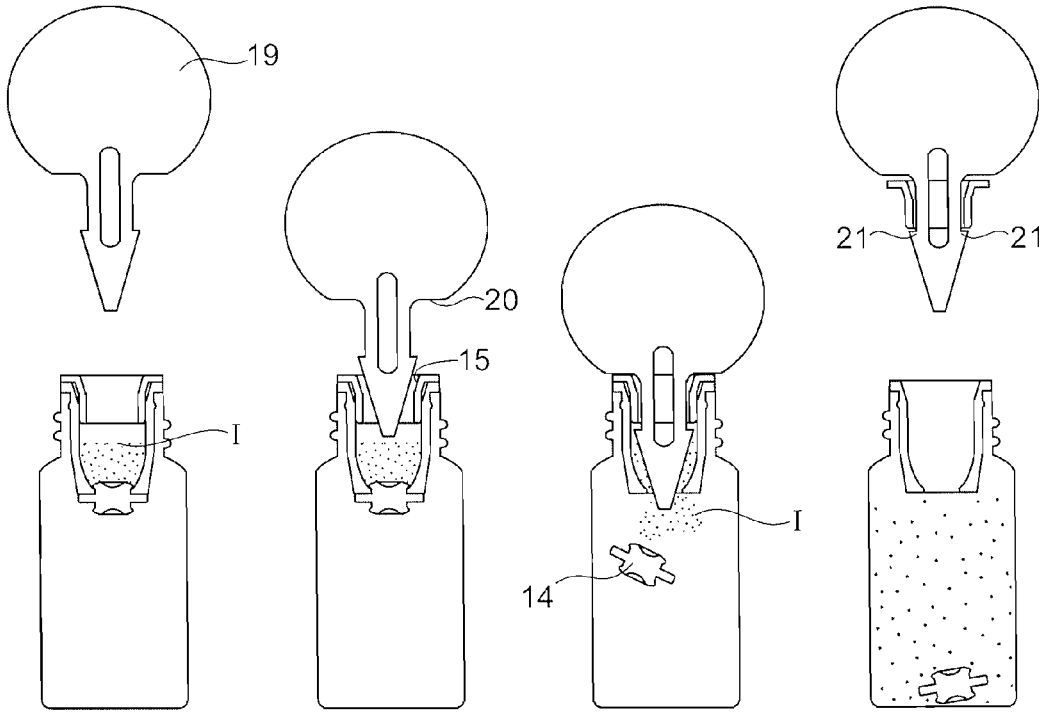
FIGS. 7*a-d* demonstrate the use of the barbed tool to remove the upper and lower seals.

To dislodge the upper and lower seals, a "multi-compartment, wiper-applicator package" according to the present invention includes a seal removal tool. One embodiment of a seal removal tool is the barbed tool (19) of FIG. 7*a-d*. The barbed tool is capable of piercing the weakened portion (16) of the upper seal (13), then dislodging the lower seal (14), and then lifting the upper seal (13) out of the wiper. When inserted into the wiper, the pointed end of the barbed tool breaks through the weakened portion of the upper seal (FIG. 7*b*). The pointed end cannot so easily break through any portion of the upper seal, except the weakened portion. Inserting the tool further, the tool comes to bear against the lower seal. With sufficient force that a consumer could supply by hand, the lower seal is dislodged and pushed into the primary compartment, completely separated from the wiper (FIG. 7*c*). At this time, the secondary ingredients fall into the primary compartment. The size and shape of the lower seal are such that it cannot, at a later time, pass through the lower orifice of the wiper. Also, the dislodged lower seal in the primary compartment causes no problems when an applicator is inserted. In fact, the dislodged lower seal may serve as a mixing element, helping to mix the first formulation and the secondary ingredients. To prevent the barbed tool from inserting too far into the wiper, a portion (20) of the barbed tool comes to rest against the flange (15) of the upper seal. By "too far into the wiper", we mean that the barbed tool should not be able to catch on the underside of the wiper, so as not to dislodge the wiper. Once the barbed tool is resting against the flange of the upper seal, raising the barbed tool will cause one or more barbs (21) to bear against a portion of the upper seal. With sufficient force that a consumer could supply by hand, the upper seal is dislodged and removed completely from the wiper (FIG. 7*d*). For all intents and purposes the container now functions like a conventional mascara container with wiper. There is no damage to the wiper and no foreign material residue on the wiper. The barbed tool and upper seal can be discarded. A closure with applicator of the type well known in the art can be inserted into the container and used to seal the container, in the usual manner.

A feature of the upper and lower seals is that they can be pushed or pulled out of the wiper and completely separated from the wiper. This feature is necessary so that the upper and lower seals, or any portion thereof, cannot interfere with the functioning of the wiper. For this reason, the upper and lower seals must be sufficiently rigid, so that when the lower seal is pushed by the barbed tool, or the upper seal is pulled by the barbed tool, each seal moves as a complete piece, without breaking or tearing. For this reason, thin membrane seals of paper, plastic, foil etc. are generally unlike the upper and lower seals of the present invention.

It is also preferable that the functioning of the wiper is not impaired, when the upper seal (13) and lower seal (14) are removed. Thus, the wiper should not be damaged by removing the seals and no foreign material should be allowed to interfere with the wiper. For example, it is preferable to effect the upper and lower airtight seals without the use of adhesives. Adhesive residue on the wiper flange (12) might interfere with the air tight seal between the wiper flange a container closure. Anything less than a complete air tight seal will lead to rapid dryout of the formulation, rendering the product unusable. Furthermore, after the lower seal is dislodged, adhesive residue on the lower portion of the wiper might interfere with the functioning of the wiper. Also, adhesives residue on the wiper could interfere with the stability of the formulation.

Thus, the preferred embodiment of the present invention does not form the upper and lower airtight seals in a way that would leave any foreign material on the wiper or that would otherwise interfere with the functioning of the wiper. Ideally, a friction fit is used.

Given the availability of a secondary compartment, there are any number of secondary ingredients that a skilled formulator might want to include in the sealed wiper. Such materials include any that can be effectively mixed into the first formulation at the time of first use and for which it is advantageous to delay their mixing until the time of first use. In general these include, but are not limited to colorants, actives, preservatives, desiccants and rheology modifiers. Functionally, these might include: curlers, lengtheners, separators, declumpers, volumizers, deflakers, despikers, lash thickeners, desmudgers, etc.

One example of an active that might benefit by being kept separate from the first formulation until the time of first use is the enzyme, transglutaminase. Transglutaminase has been used in eyelash products to retain the curl the lashes. However, the activity of transglutaminase depends on several factors, including the pH of the formulation in which it is disposed (5 to about 9 is recommended and about 6 to about 7 is particularly preferred), exposure to heat (should be avoided), exposure to certain types of surfactants (anionic surfactants adversely affect the enzyme) and the length of time that it is exposed to these factors. Thus, if the first formulation is not optimum for preserving transglutaminase activity, it would be beneficial to keep the transglutaminase separate from the first formulation until the time of first use. The transglutaminase would be protected from the adverse conditions in the first formulation for the entire shelf time of the product. After first use, the transglutaminase will not be protected, but the amount of lost activity may be acceptable over the expected use life of the product. Many such instances might arise, where a benefit would be achieved by keeping one or more secondary ingredients separate from the first formulation until the time of first use.

Figure 8:
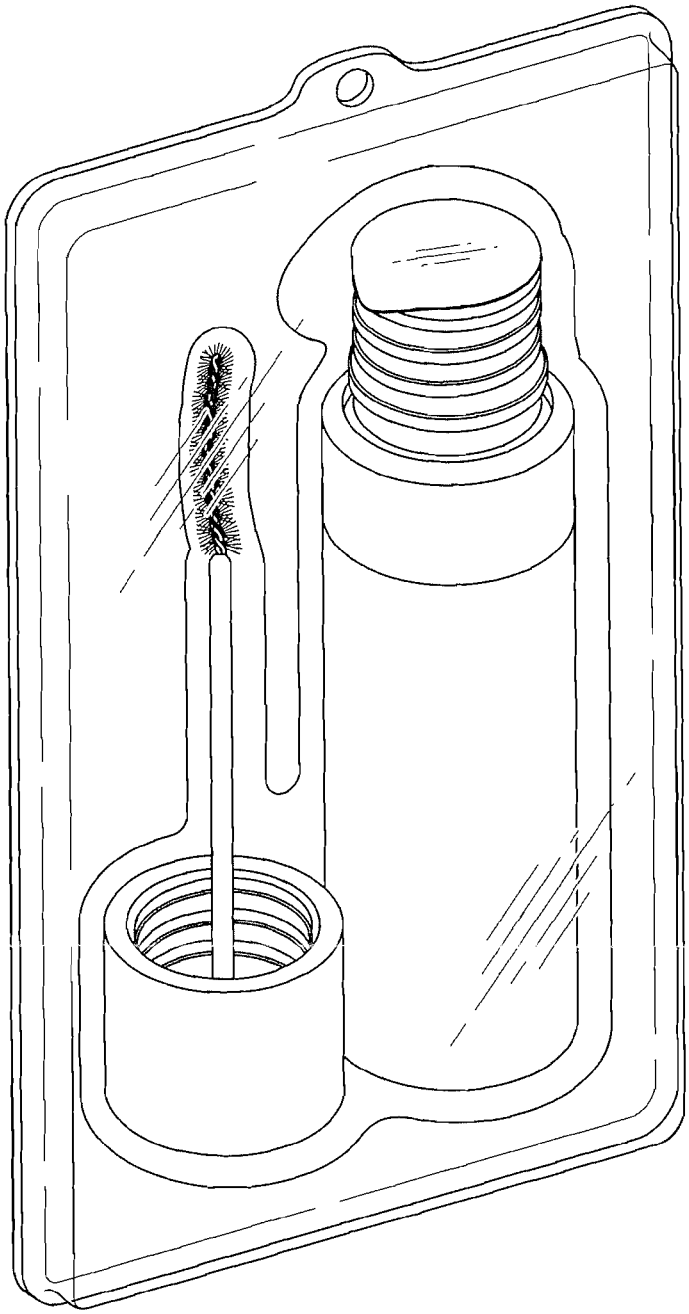
FIG. 8 shows a kit comprising a container that has a wiper as described herein (not visible), and a closure-applicator.

In a "multi-compartment, wiper-applicator package" according to the present invention, the bottle and closure-applicator are physically separate before the first use. Therefore, the present invention includes a kit comprising a container with wiper as described herein, the container holding a first formulation and the wiper holding one or more secondary ingredients; and a closure-applicator (23) (see FIG. 8).

Optionally, a closure (22) without integral applicator is also supplied with the kit. The closure without applicator can be screwed onto the container to give a more finished appearance. Preferably, however, the container with wiper is sufficiently air tight without the closure.

Improvements to the inventions so far described can be achieved by adding features already known in the art. For example, a multi-compartment mascara package according to the present invention would be even more useful and create wider formulation possibilities if combined with a vibrating applicator. In fact, the vibrating applicator could be used, among other things, to mix the secondary ingredients into the first formulation. One example of a vibrating applicator is described in US2006-0032512.

Another improvement is expected by combining "multi-compartment, wiper-applicator package" according to the present invention with a heated applicator. The heat may be useful for activating some secondary ingredients, or for lowering the viscosity of the first formulation to the allow the secondary ingredients to mix better. One example of a cosmetic applicators containing heating elements is described in US2007-0286665. Thus, if energy can be introduced into the container (i.e. heat or vibration, etc), the ability to mix ingredients at the time of first use increases the formulation possibilities many fold.

What we claim is:

1. A multi-compartment, wiper-applicator package comprising:

a container that defines a primary compartment that is capable of holding a first formulation, the container having a neck with an orifice;

a wiper that defines a secondary compartment that is capable of holding a quantity of secondary ingredients, the wiper being situated in the neck of the container and having an upper and lower orifice;

a removable upper seal that when inserted into the wiper closes off the upper orifice, such that when the removable upper seal is dislodged from the wiper, the wiper remains in the neck of the container;

a lower seal closing off the lower orifice, such that when the lower seal is separated from the wiper, the lower seal falls into the primary compartment;

a quantity of secondary ingredients located in the secondary compartment.

2. The multi-compartment, wiper-applicator package of claim 1 wherein the upper and lower seals are friction fit into the wiper upper and lower orifices, respectively.

3. The multi-compartment, wiper-applicator package of claim 2 wherein the upper seal further comprises a flange that rests against the wiper, when the upper seal is fully seated in the wiper.

4. The multi-compartment, wiper-applicator package of claim 2 wherein the lower seal further comprises a flange that rests against the wiper, when the lower seal is fully seated in the wiper.

5. A method of using a multi-compartment, wiper-applicator package of claim 2 comprising:

piercing the weakened portion of the upper seal with the barbed tool;

dislodging the lower seal by pushing the barbed tool against the lower seal;

lifting the upper seal out of the wiper with the barbed tool.

6. The multi-compartment, wiper-applicator package of claim 1 wherein the upper seal has a weakened portion.

7. The multi-compartment, wiper-applicator package of claim 1 further comprising a closure for the container.

8. The multi-compartment, wiper-applicator package of claim 1 further comprising a seal removal tool.

9. The multi-compartment, wiper-applicator package of claim 8 wherein the seal removal tool is a barbed tool.

10. The multi-compartment, wiper-applicator package of claim 9, wherein the barbed tool has a portion that rests against the flange of the upper seal when the barbed tool is fully inserted into the upper seal.

11. A method of filling and assembling a multi-compartment, wiper-applicator package of claim 1 comprising:

filling the primary compartment of the container;

affixing the lower seal to the wiper;

filling the secondary compartment of the wiper;

affixing the upper seal to the wiper; and affixing the wiper into the container orifice.

12. A method of filling and assembling a multi-compartment, wiper-applicator package of claim 1 comprising:

filling the primary compartment of the container;

affixing the lower seal to the wiper;

affixing the wiper into the container orifice;

filling the secondary compartment of the wiper; and affixing the upper seal to the wiper.

13. A multi-compartment, wiper-applicator package of claim 1 further comprising a closure-applicator.

14. A multi-compartment, wiper-applicator package of claim 13 wherein in the closure applicator is a vibrating applicator.

15. A multi-compartment, wiper-applicator package of claim 13 wherein in the closure applicator is a heated applicator.

16. A multi-compartment, wiper-applicator package of claim 1 wherein the secondary compartment contains an enzyme.

17. A multi-compartment, wiper-applicator package of claim 16 wherein the enzyme is transglutaminase.

* * * * *